US005642577A

United States Patent [19]

Kallenberger

[11] Patent Number: 5,642,577

[45] Date of Patent: Jul. 1, 1997

[54] DRAGLINE WITH HIGH HEADROOM BETWEEN UPPER AND LOWER STRUCTURES

[75] Inventor: Harvey J. Kallenberger, Wind Lake, Wis.

[73] Assignee: Harnischfeger Corporation, St. Francis, Wis.

[21] Appl. No.: 536,701

[22] Filed: Sep. 29, 1995

[51] Int. Cl.[6] ..... E02F 3/58

[52] U.S. Cl. ..... 37/397; 37/394; 37/395; 212/253

[58] Field of Search ..... 37/397, 384, 395; 248/678; 212/253, 291, 271; 180/8.1, 8.5, 89.13; 414/718, 569

[56] References Cited

U.S. PATENT DOCUMENTS

| | | | |
|---|---|---|---|
| 1,001,299 | 8/1911 | Page | 180/8.1 |
| 1,511,437 | 10/1924 | Bager et al. | 37/397 X |
| 4,014,399 | 3/1977 | Ruder | 180/8.5 |
| 4,406,339 | 9/1983 | Spencer | 180/8.5 |
| 4,555,032 | 11/1985 | Mick et al. | 180/8.5 X |
| 4,769,932 | 9/1988 | Kalve | 248/678 X |
| 5,154,012 | 10/1992 | Kallenberger | 37/116 |
| 5,154,013 | 10/1992 | Kallenberger | 37/397 |

FOREIGN PATENT DOCUMENTS

| | | | |
|---|---|---|---|
| 974377 | 12/1960 | Germany | 212/253 |
| 1141765 | 12/1962 | Germany | 212/253 |
| 1925435 | 2/1971 | Germany | 212/253 |
| 2818612 | 12/1978 | Germany | 212/253 |
| 477932 | 7/1975 | Russian Federation | 212/291 |
| 1709035 | 1/1992 | Russian Federation | 37/397 |
| 786621 | 11/1957 | United Kingdom | 212/253 |

*Primary Examiner*—Terry Lee Melius
*Assistant Examiner*—Thomas A. Beach
*Attorney, Agent, or Firm*—Michael, Best & Friedrich

[57] ABSTRACT

Heavy machinery comprising a lower support structure having an upper surface, and an upper structure having a generally horizontal lower surface facing the upper surface of the lower structure, the upper structure being supported above the lower structure for rotation relative to the lower structure about a generally vertical axis, and the lower surface of the upper structure having therein an upwardly extending recess surrounding the axis to provide space for a person working on the machinery, the recess being defined at least in part by an upper wall above and generally parallel to the lower surface, and by a plurality of generally planar facets surrounding the axis, each of the facets extending transversely to the upper wall and to the lower surface.

10 Claims, 5 Drawing Sheets

DRAGLINE WITH HIGH HEADROOM BETWEEN UPPER AND LOWER STRUCTURES

BACKGROUND OF THE INVENTION

1. Field of the Invention

The invention relates to large machines having relatively rotatable upper and lower structures. More particularly, the invention relates to draglines.

2. Discussion of Prior Art

A walking dragline typically includes an upper structure and a boom which extends upwardly and outwardly from the upper structure and which has thereon a sheave for supporting a hoist rope. The hoist rope extends over the sheave to a bucket for causing vertical movement of the bucket. A drag rope is connected to the bucket for causing horizontal movement of the bucket. The upper structure is supported by a tub that sits on the ground when the dragline is engaged in digging operations. The upper structure is rotatable relative to the tub about a vertical pivot axis. A pair of walking mechanisms are mounted on the opposite sides of the upper structure and are operable for moving the dragline over the ground between digging operations.

Historically, heavy equipment such as draglines with rotating upper structures have had minimal clearance between the upper rotating structure and the top of the lower support structure when employing a flat top for the lower structure. This has made maintenance of equipment in that area, such as the mechanical and electrical equipment involved with rotating the upper structure relative to the lower structure, a difficult task. Improving human access in this area would allow the user of the equipment to more easily inspect, maintain, and repair the rotating machinery and any other equipment that may be located in the area. Some machines have structural elements added to the bottom surface of the upper deck. These elements often result in cracking problems with the main structure due to the method of attachment.

SUMMARY OF THE INVENTION

The invention provides, on the bottom surface of the upper structure, a contour that greatly enhances accessibility between the upper and lower structures, without sacrificing the structural integrity of the upper structure and its ability to carry the dead weight of the equipment and designed operating loads, and without increasing the depth of the upper structure or its total weight. Any change in depth would unnecessarily add to the size of the structure, presenting manufacturing and shipping difficulties and increasing cost.

More particularly, the bottom surface of the upper structure has a circular relief cavity or recess centered on the pivot axis. The upper wall of the cavity is preferably parallel to the bottom surface of the upper structure. The inner and outer walls of the cavity are formed by multiple planar facets. The number of facets on the inner and outer walls do not have to be the same. The structural integrity of the upper structure is maintained by having all facets inclined relative to the bottom surface of the upper structure. Each juncture line formed by the intersection of a facet plane with any adjacent plane (the bottom surface of the upper structure, the upper wall of the cavity or an adjacent facet plane) is structurally supported by an internal support diaphragm or plate normal to the bottom surface of the upper structure. These diaphragms become integral structural members of the overall upper structure.

The height provided by the relief cavity provides additional clearance necessary for improved access between the upper and lower structures.

Other features and advantages of the invention will become apparent to those skilled in the art upon review of the following detailed description, claims and drawings.

Figure 1:
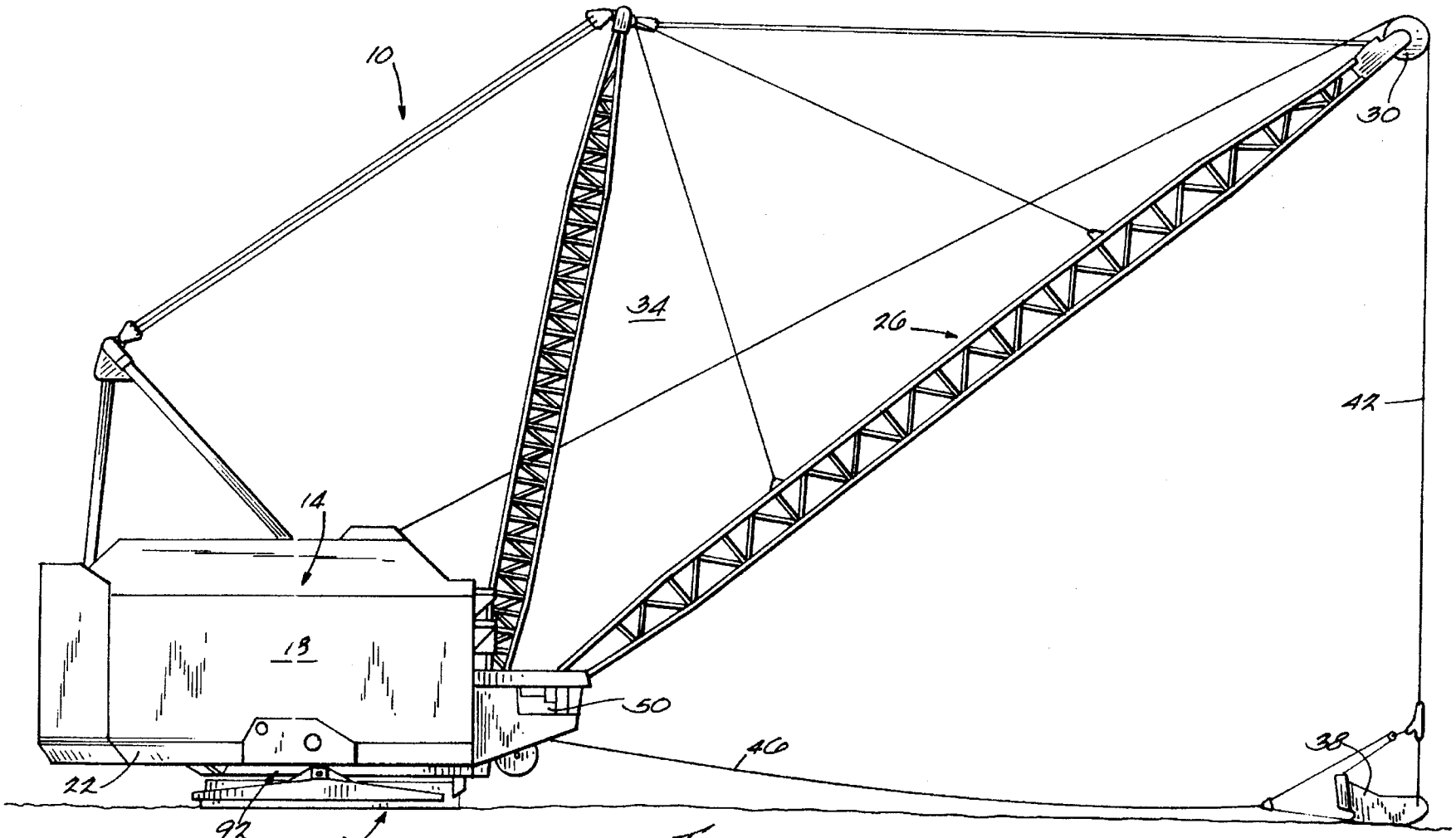
FIG. 1 is a side elevational view of a dragline embodying the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A dragline 10 embodying the invention is illustrated in the drawings. The dragline 10 comprises (FIG. 1) an upper structure 14 including a main housing 18 mounted on top of a deck 22. The dragline 10 also includes, inside the main housing 18, a bucket hoist mechanism (not shown) and a bucket drag mechanism (not shown). A boom 26 extends upwardly and outwardly from the upper structure 14. The upper end of the boom 26 has thereon a sheave 30. The boom 26 is supported relative to the upper structure 14 by conventional supporting structure 34. The dragline 10 also includes a bucket 38, a hoist rope 42 extending between the bucket hoist mechanism and the bucket 38 and over the sheave 30 for causing vertical movement of the bucket 38, and a drag rope 46 extending between the bucket drag mechanism and the bucket 38 for causing horizontal movement of the bucket 38. An operator's cab 50 is mounted on the upper structure 14.

Figure 2:
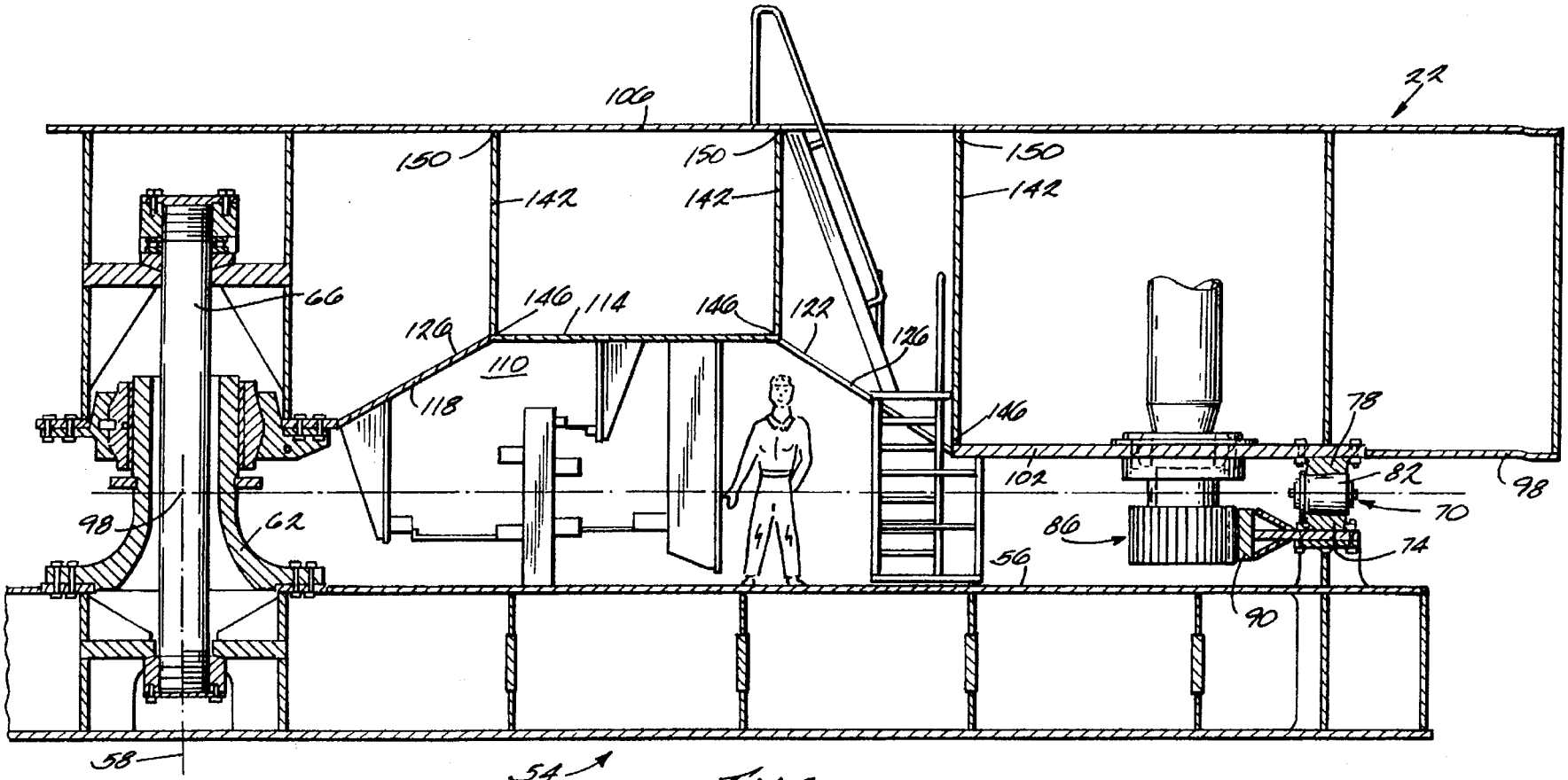
FIG. 2 is a partial vertical cross-sectional view of the dragline.

The dragline 10 further includes a lower structure or tub 54 which sits on the ground and supports the upper structure 14 during digging operations. The tub 54 has an upper surface 56. The tub 54 is described below in greater detail. The upper structure 14 is rotatable relative to the tub 54 about a vertical axis 58 (see FIG. 2). More particularly, the deck 22 rotates about a center pintle 62 which is mounted on the lower structure 54 and which is centered on the pivot axis 58. A lifting pin 66 extends along the axis 58 and connects the upper structure 14 to the lower structure 54. A bearing assembly 70 supports the upper structure 14 above the lower structure 54. The bearing assembly 70 includes a circular lower rail 74 on the lower structure 54, a circular upper rail 78 on the upper structure 14, and a plurality of rollers 82 between the rails 74 and 78. The upper structure 14 is rotated relative to the lower structure 54 by a gear drive 86 which is mounted on the upper structure 14 and which engages a circular ring gear 90 mounted on the lower structure 54. The dragline 10 also comprises (see FIG. 1) a pair of walking mechanisms 92 (only one is shown) which move the dragline 10 over the ground between digging operations.

Figure 4:
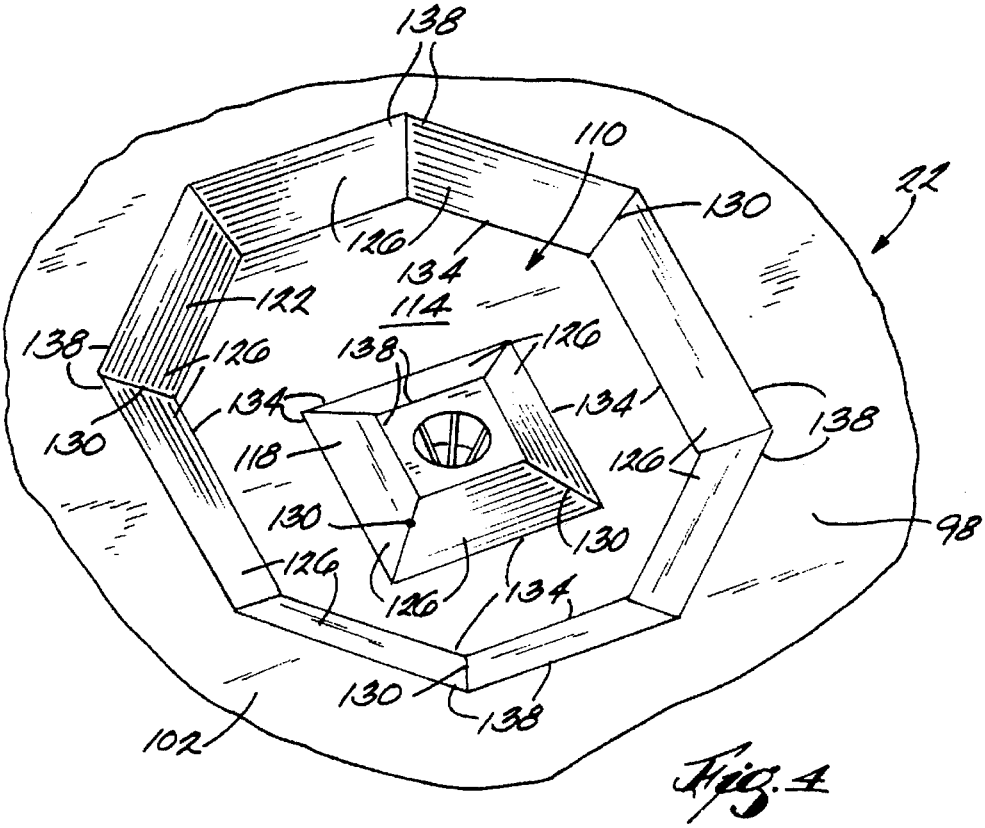
FIG. 4 is a partial perspective view of the bottom of the deck showing the circular recess therein.

The deck 22 has (see FIGS. 2 and 4) a lower plate 98 defining a generally horizontal lower surface 102 facing the upper surface 56 of the tub 54. The deck 22 also includes (see FIG. 2) a generally horizontal upper plate 106 which is spaced above the lower surface 102. To provide access for a person working on the machinery, the lower surface 102 of the deck 22 has therein (see FIGS. 2 and 4) an upwardly extending recess 110 surrounding the pivot axis. The recess 110 is defined by a generally horizontal upper wall 114 above the lower surface 102, by an outwardly facing inner wall 118 extending between the upper wall 114 and the lower surface 102, and by an inwardly facing outer wall 122 extending between the upper wall 114 and the lower surface 102.

Figure 3:
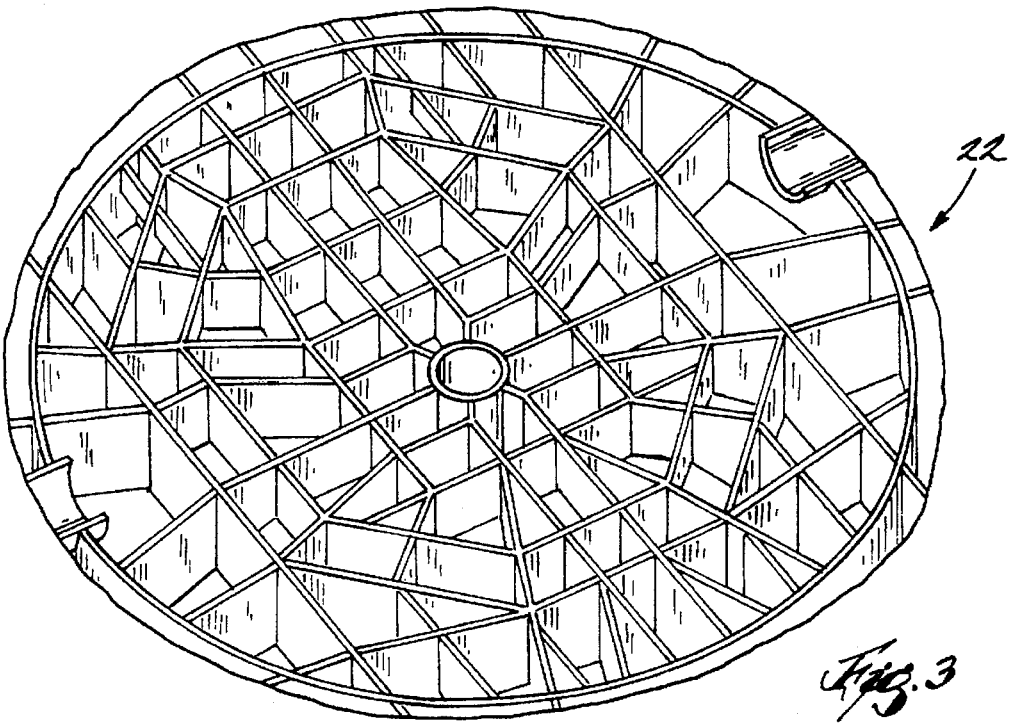
FIG. 3 is a partial perspective view of the top of the deck with the upper plate removed.
Figure 5:
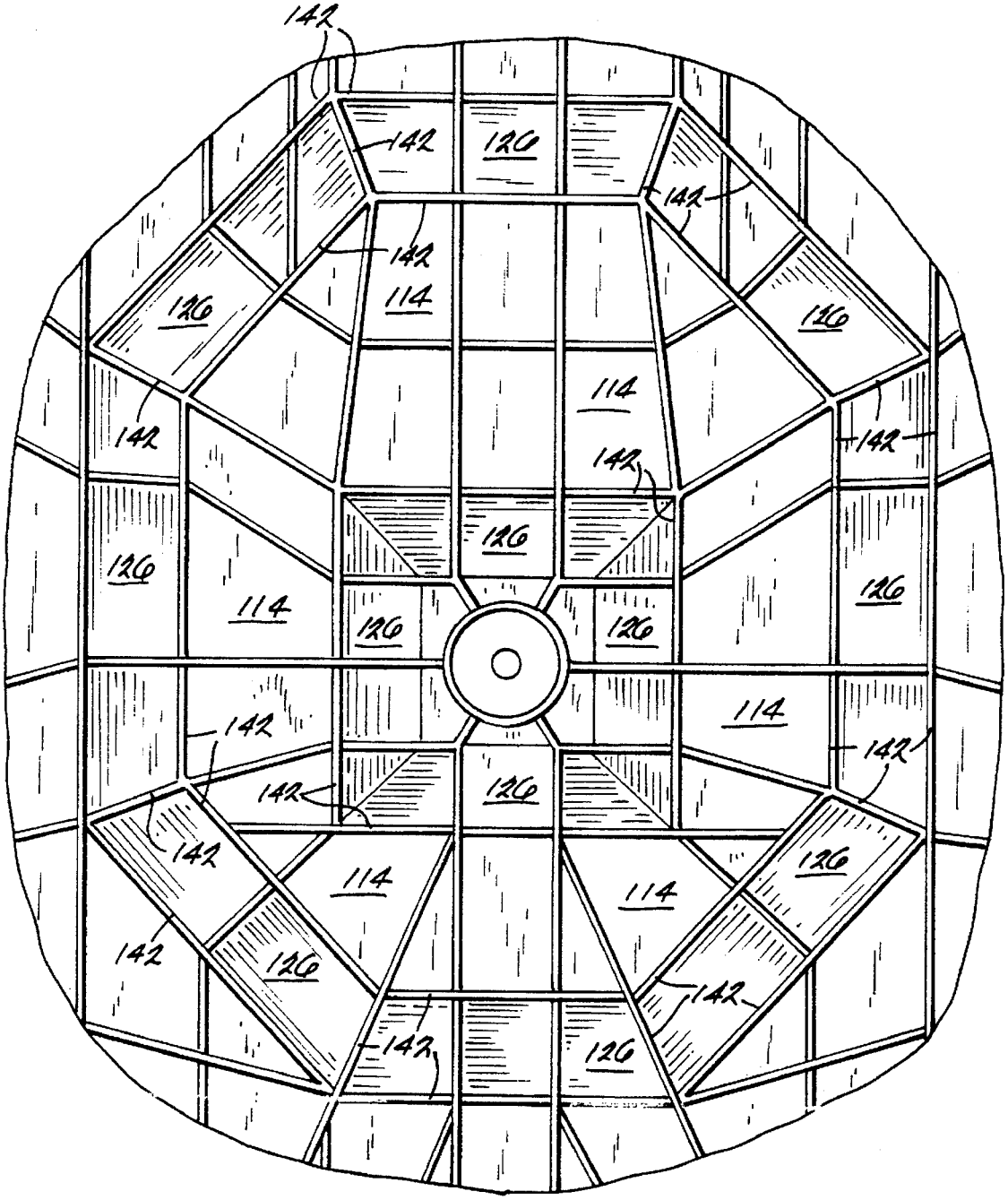
FIG. 5 is a top plan view of the portion of the deck shown in FIG. 3.
Figure 6:
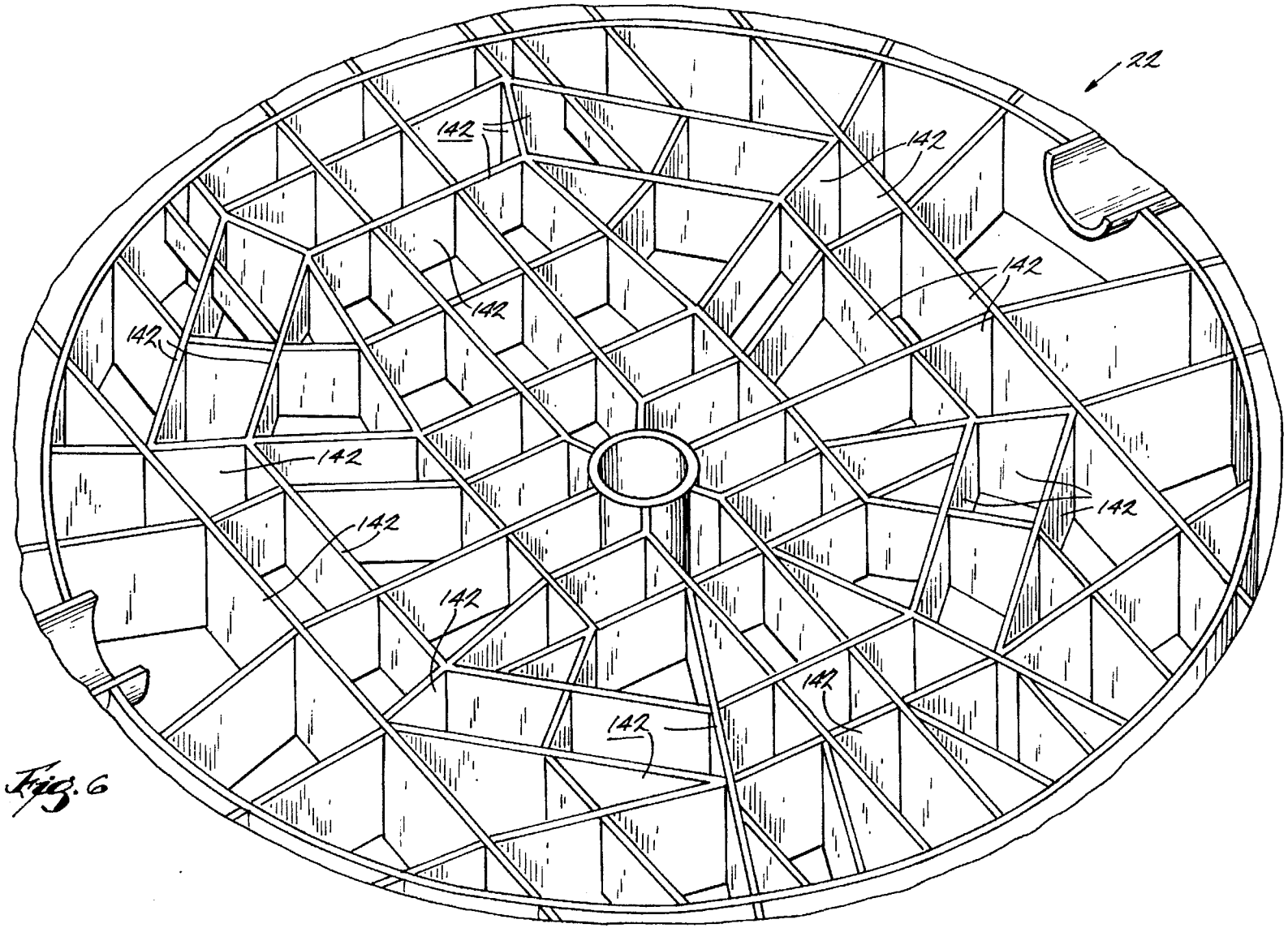
FIG. 6 is FIG. 3 enlarged.

Each of the walls 118 and 122 is defined by (see FIG. 4) a plurality of planar facets or plates 126 surrounding the axis. Each facet 126 is inclined upwardly from the lower surface 102 to the upper wall 114 and has opposite side edges 130 and opposite upper and lower edges 134 and 138. Each side edge 130 has a linear junction with the side edge 130 of an abutting facet 126. Each upper edge 134 has a linear junction with the upper wall 114, and each lower edge 138 has a linear junction with the lower surface or plate 98. Each junction is supported by (see FIGS. 2, 3 and 5) a respective support plate 142 which extends vertically and has a lower edge 146 (see FIG. 2) abutting the facets 126 forming the junction. Each support plate 142 also has an upper edge 150 abutting the upper plate 106, and opposite vertical edges (not numbered) each having a linear junction with an abutting support plate 142. All of the plates 98, 106, 126 and 142 are preferably welded to all abutting plates. This construction maximizes the structural integrity of the deck 22. As shown in FIGS. 5 and 6, additional support plates (not numbered) are preferably also provided where desirable to increase the structural integrity of the deck 22.

Various features of the invention are set forth in the following claims.

I claim:

1. A dragline comprising a lower support structure having a generally horizontal upper surface, and an upper structure having a generally horizontal lower surface facing said upper surface of said lower structure, said upper structure being supported above said lower structure for rotation relative to said lower structure about a generally vertical axis, and said lower surface of said upper structure having therein an upwardly extending recess surrounding said axis to provide access space for a person working on the dragline, said recess being defined at least in part by an upper wall above and generally parallel to said lower surface, and by a plurality of generally planar facets surrounding said axis, each of said facets extending transversely to said upper wall and to said lower surface, a boom extending from said upper structure, said boom having thereon a sheave, a bucket, a hoist rope extending over said sheave to said bucket for causing vertical movement of said bucket, and a drag rope connected to said bucket for causing horizontal movement of said bucket.

2. A dragline as set forth in claim 1 wherein each of said facets has opposite side edges each having a generally linear junction with an abutting one of said facets.

3. A dragline as set forth in claim 2 wherein each of said facets has an upper edge having a generally linear junction with said upper wall, and has a lower edge having a generally linear junction with said lower surface.

4. A dragline as set forth in claim 3 wherein said junctions are supported by respective support plates each having a lower edge abutting the associated facets at the associated junction, said support plates extending generally perpendicular to said lower surface.

5. A dragline as set forth in claim 4 wherein said upper structure also includes a generally horizontal upper plate spaced above said lower surface, and wherein each of said support plates has an upper edge abutting said upper plate.

6. A dragline as set forth in claim 5 wherein each of said support plates has opposite generally vertical edges each having a generally linear junction with an abutting one of said support plates.

7. A dragline as set forth in claim 1 wherein each of said facets is a plate.

8. A dragline as set forth in claim 1 wherein each of said facets is inclined upwardly from said lower surface to said upper wall.

9. A dragline comprising a lower support structure having a generally horizontal upper surface, and an upper structure having a generally horizontal lower surface facing said upper surface of said lower structure, said upper structure being supported above said lower structure for rotation relative to said lower structure about a generally vertical axis, and said lower surface of said upper structure having therein an upwardly extending recess surrounding said axis to provide access space for a person working on the dragline, said recess being defined at least in part by an upper wall above and generally parallel to said lower surface, and by a plurality of generally planar facets surrounding said axis, each of said facets extending transversely to said upper wall and to said lower surface, wherein said recess is also defined by an outwardly facing inner wall extending between said upper wall and said lower surface, and by an inwardly facing outer wall extending between said upper wall and said lower surface, and wherein said facets form one of said inner and outer walls, a boom extending from said upper structure, said boom having thereon a sheave, a bucket, a hoist rope extending over said sheave to said bucket for causing vertical movement of said bucket, and a drag rope connected to said bucket for causing horizontal movement of said bucket.

10. A dragline as set forth in claim 9 wherein the other of said inner and outer walls is also formed by a plurality of generally planar facets surrounding said axis and each extending transversely to said upper wall and to said lower surface.

* * * * *